US011772922B2

(12) United States Patent
Fuwa

(10) Patent No.: US 11,772,922 B2
(45) Date of Patent: Oct. 3, 2023

(54) CONVEYING APPARATUS WITH CONVEYANCE SURFACE FACING DOWNWARD

(71) Applicant: RISO KAGAKU CORPORATION, Tokyo (JP)

(72) Inventor: Hiroki Fuwa, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 17/507,089

(22) Filed: Oct. 21, 2021

(65) Prior Publication Data

US 2022/0135355 A1 May 5, 2022

(30) Foreign Application Priority Data

Oct. 30, 2020 (JP) ..... 2020-182515
Jul. 28, 2021 (JP) ..... 2021-123068

(51) Int. Cl.

| | |
|---|---|
| ***B65H 5/22*** | (2006.01) |
| ***B65H 5/02*** | (2006.01) |
| ***B65H 29/24*** | (2006.01) |
| ***B65H 7/12*** | (2006.01) |
| ***B65H 7/16*** | (2006.01) |

(52) U.S. Cl.

CPC ..... *B65H 7/12* (2013.01); *B65H 5/021* (2013.01); *B65H 5/224* (2013.01); *B65H 7/16* (2013.01); *B65H 2301/324* (2013.01); *B65H 2301/4234* (2013.01); *B65H 2511/524* (2013.01); *B65H 2553/42* (2013.01)

(58) Field of Classification Search

CPC ..... B65H 5/224; B65H 5/021; B65H 7/16; B65H 2301/324; B65H 2301/4234; B65H 2301/44734; B65H 2301/44735; B65H 2406/323; B65H 2406/32; B65H 2511/524; B65H 2511/528; B65H 2601/11; B65H 2601/321; B65H 29/242; B65H 5/38; B65H 29/52; G03G 21/1638

See application file for complete search history.

(56) References Cited

U.S. PATENT DOCUMENTS 6,595,739 B1 * 7/2003 LaPlace ..... B65G 21/2036 198/689.1
2020/0070498 A1 3/2020 Kawai

FOREIGN PATENT DOCUMENTS

| | | | |
|---|---|---|---|
| JP | 61051462 A | * | 3/1986 |
| JP | 61217474 A | * | 9/1986 |
| JP | 2000198557 A | * | 7/2000 |
| JP | 2006168890 A | * | 6/2006 |
| JP | 2020-37486 | | 3/2020 |

* cited by examiner

*Primary Examiner* — Luis A Gonzalez
(74) *Attorney, Agent, or Firm* — Greenblum & Bernstein, P.L.C.

(57) ABSTRACT

A conveying apparatus includes a conveyor and a conveyed object receptor. The conveyor includes a conveyance surface facing downward and configured to convey a conveyed object having a sheet-like shape. The conveyed object receptor is arranged below the conveyor and configured to receive the conveyed object having fallen from the conveyor.

4 Claims, 5 Drawing Sheets

CONVEYING APPARATUS WITH CONVEYANCE SURFACE FACING DOWNWARD

CROSS REFERENCE TO RELATED APPLICATION

This application is based upon and claims the benefit of priority from the prior Japanese Patent Application Nos. 2020-182515 filed on Oct. 30, 2020 and 2021-123068 filed on Jul. 28, 2021, the entire contents of which are incorporated herein by reference.

BACKGROUND

1. Technical Field

The disclosure relates to a conveying apparatus which conveys sheet-like conveyed objects.

2. Related Art

There may be a need to convey a sheet having both surfaces on which images are formed by an image forming apparatus while inspecting the images on the both surfaces of the sheet.

Japanese Patent Application Publication No. 2020-37486 discloses an image inspection apparatus which performs image inspection as described above. The image inspection apparatus includes a first conveyor at an upstream side with a conveyance surface for conveying a sheet arranged to face upward, a second conveyor adjacent to the conveyance surface of the first conveyor with a conveyance surface for conveying the sheet arranged to face downward, a first inspection unit which inspects an obverse surface of the sheet conveyed by the first conveyor, and a second inspection unit which inspects a reverse surface of the sheet conveyed by the second conveyor.

SUMMARY

When a sheet jam occurs in the image inspection apparatus above, fans for allowing the sheet to be sucked on the conveyance surfaces in the first conveyor and the second conveyor are switched off for removal of the jam. Thus, the sheet remaining in the second conveyor falls inside the apparatus. It is difficult for a user to identify a location of the fallen sheet in the image inspection apparatus above.

The disclosure is directed to a conveying apparatus which allows easy identification of a location of a conveyed object having fallen inside the conveying apparatus.

A conveying apparatus in accordance with some embodiments includes a conveyor and a conveyed object receptor. The conveyor includes a conveyance surface facing downward and configured to convey a conveyed object having a sheet-like shape. The conveyed object receptor is arranged below the conveyor and configured to receive the conveyed object having fallen from the conveyor.

According to the aforementioned configurations, a location of a conveyed object having fallen inside the conveying apparatus can be easily identified.

DETAILED DESCRIPTION

Figure 1:
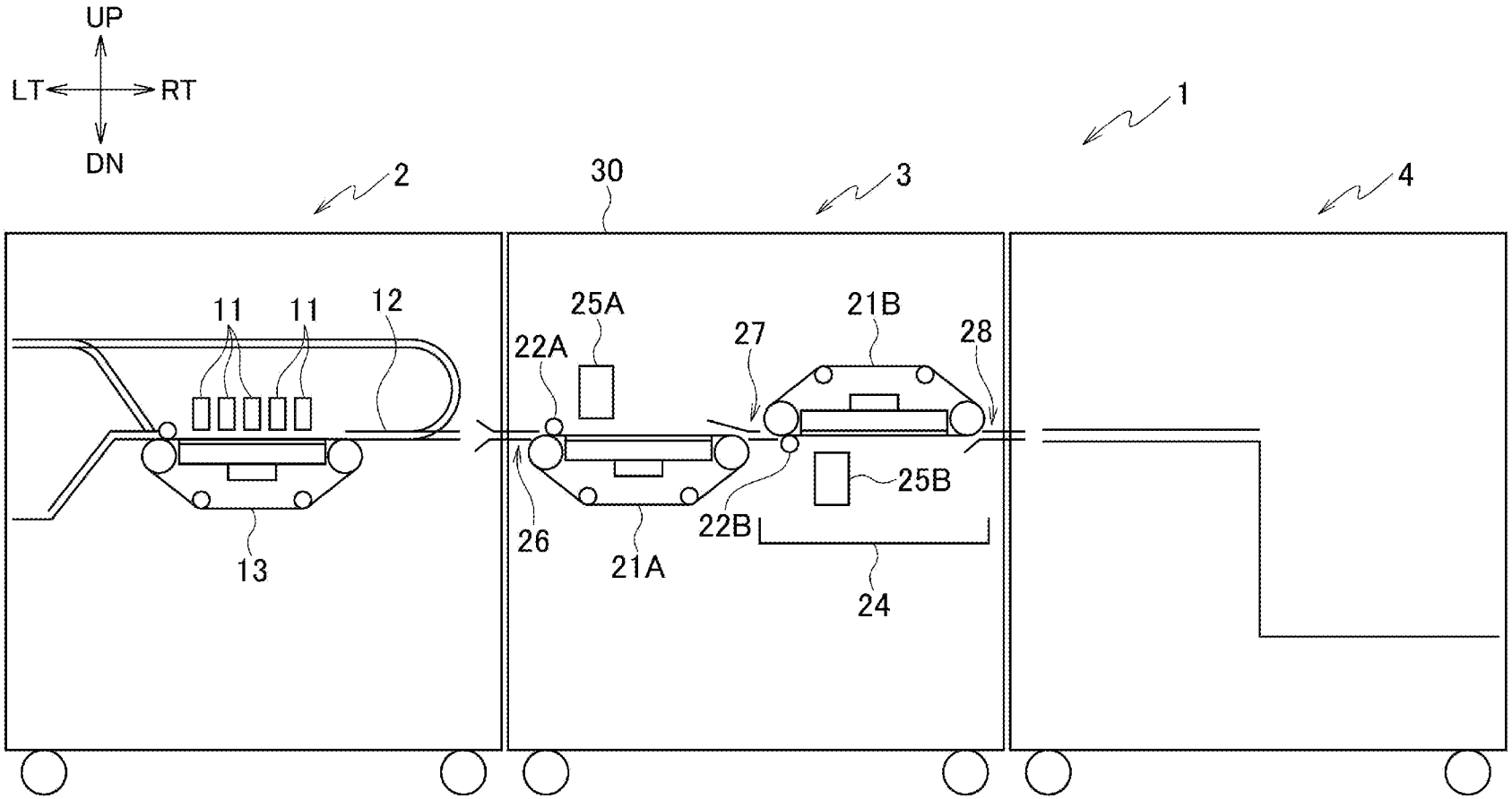
FIG. 1 is a schematic configuration diagram of an image forming system according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
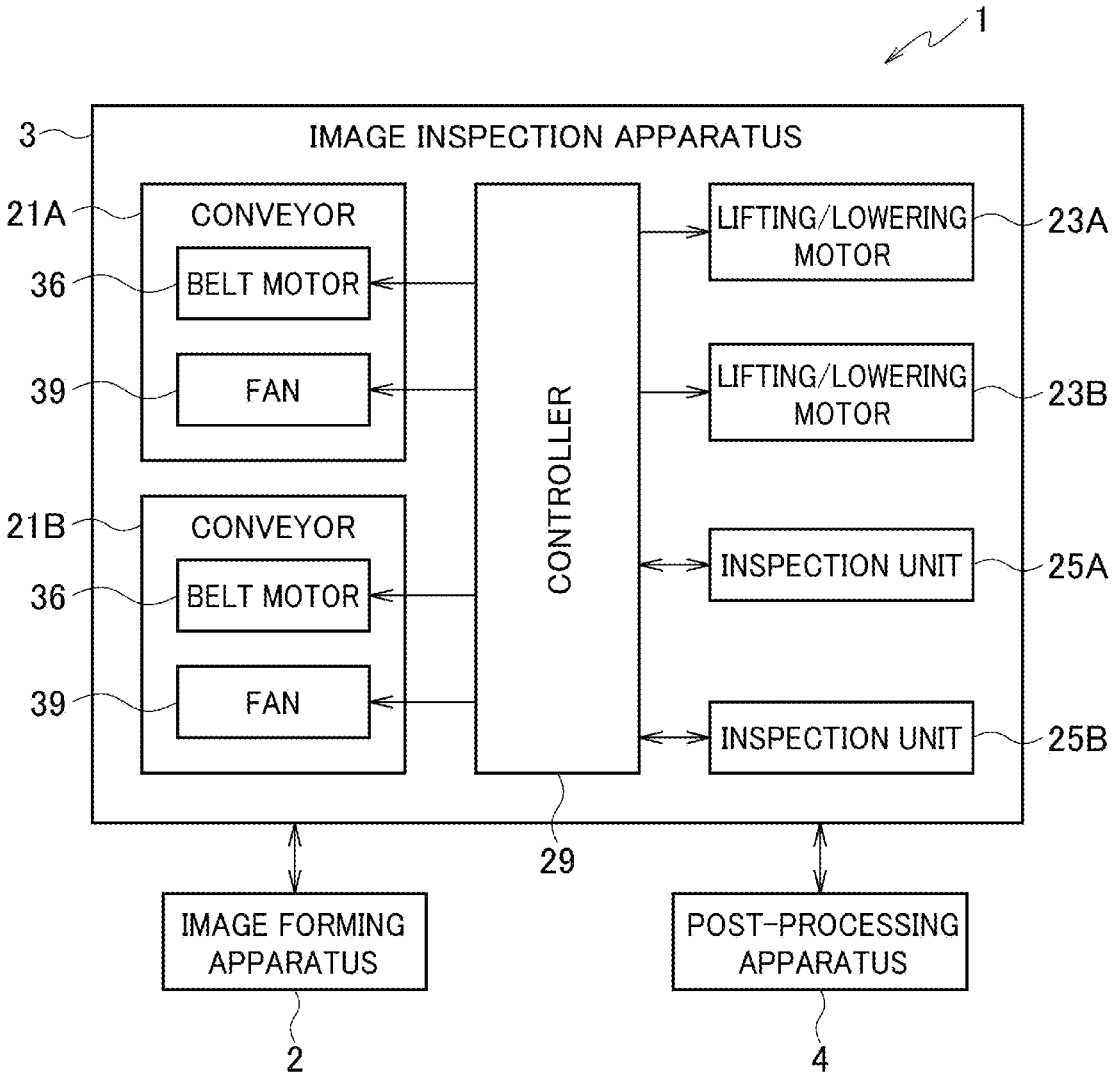
FIG. 2 is a control block diagram of the image forming system of FIG. 1.
Figure 3:
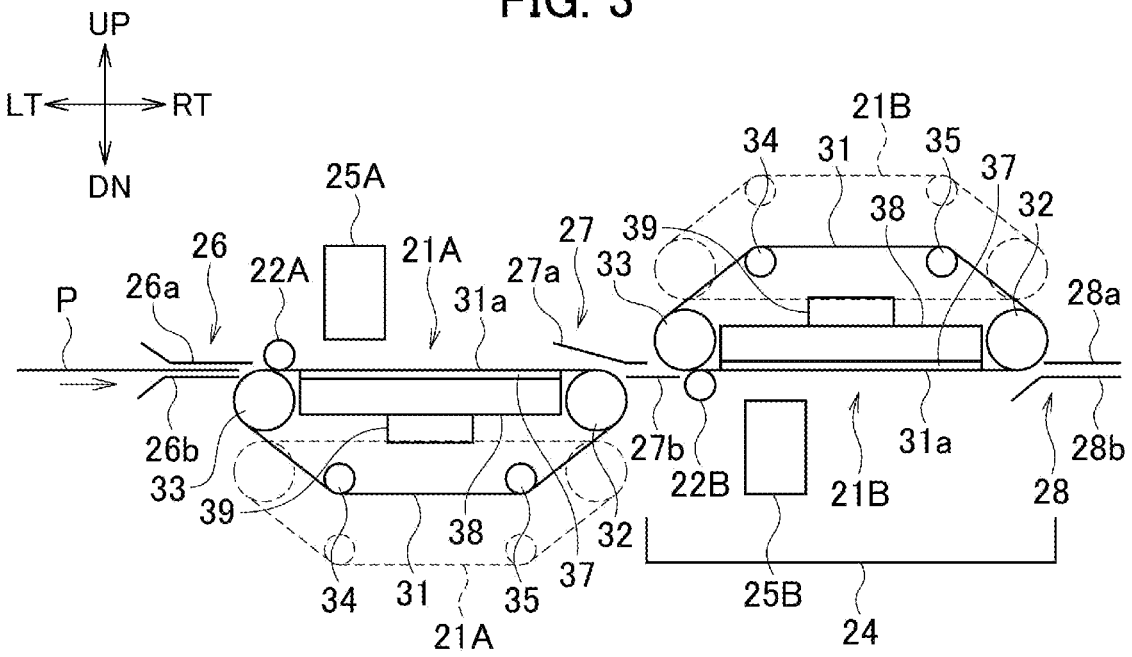
FIG. 3 illustrates a main part of an image inspection apparatus of the image forming system of FIG. 1.
Figure 4:
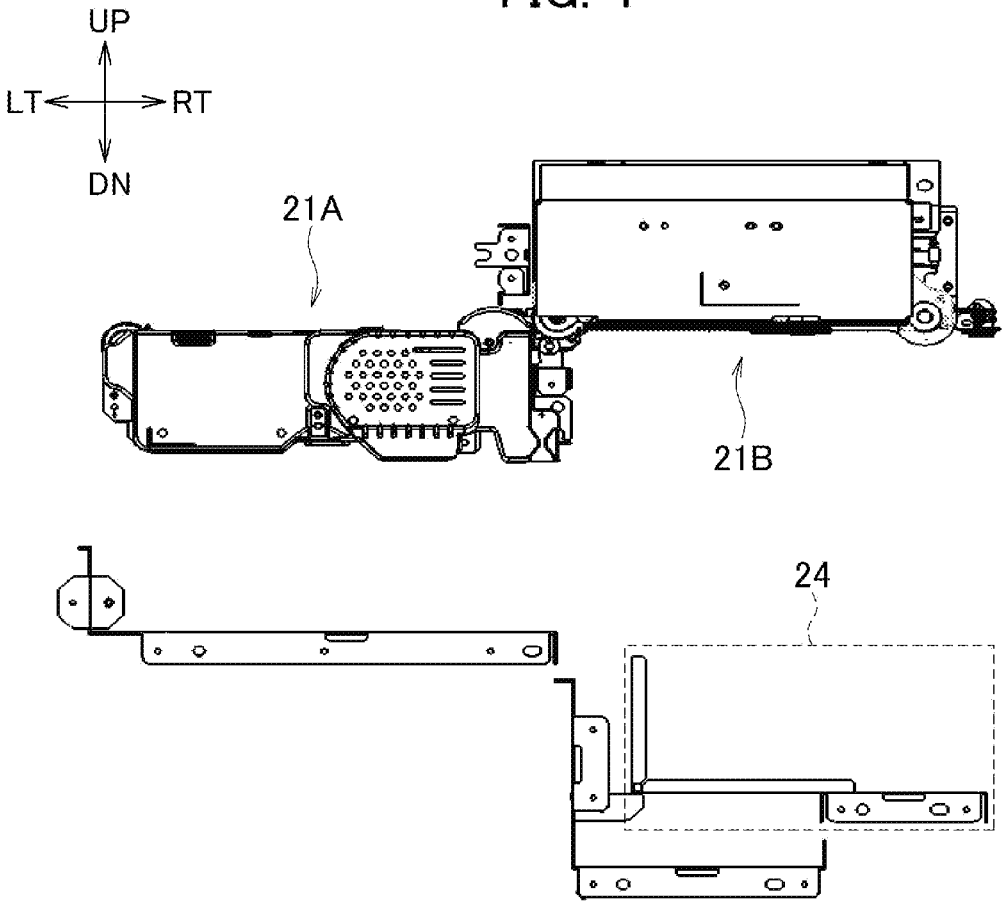
FIG. 4 illustrates a conveyor and a sheet receptor of the image inspection apparatus of the image forming system of FIG. 1.

FIG. 1 is a schematic configuration diagram of an image forming system 1 including an image inspection apparatus 3 with a conveying apparatus according to an embodiment of the invention. FIG. 2 is a control block diagram of the image forming system 1 of FIG. 1. FIG. 3 illustrates a main part of the image inspection apparatus 3 of the image forming system 1 of FIG. 1. FIG. 4 illustrates conveyors 21A and 21B and a sheet receptor 24 of the image inspection apparatus 3. In the following description, right and left, and up and down in the sheet surface of FIG. 1 are referred to as right-left direction and up-down direction. In FIG. 1, the direction from left to right is a conveyance direction of a sheet P which is a conveyed object having a sheet-like shape (see FIG. 3). Upstream and downstream in the following description mean upstream and downstream in the conveyance direction of the sheet P. In FIGS. 1 and 3 to 6, right, left, up, and down direction are denoted by RT, LT, UP, and DN, respectively.

As illustrated in FIGS. 1 and 2, the image forming system 1 according to the embodiment includes an image forming apparatus 2, the image inspection apparatus 3, and a post-processing apparatus 4.

The image forming apparatus 2 includes inkjet heads which eject ink of different colors respectively, a conveyance path 12 for conveying the sheet P, and a conveyor 13 provided directly below (under) the inkjet heads 11 and connected with the conveyance path 12. It should be noted that illustrations for other components such as a supplying means for the sheet P are omitted.

The image forming apparatus 2 is able to perform printing on one surface of the sheet P by the inkjet heads 11 while conveying the sheet P by the conveyor 13, reverse the sheet P in the conveyance path 12, refeed the sheet P to the conveyor 13, and then perform printing on the other surface of the sheet P by the inkjet heads 11 while conveying the sheet P by the conveyor 13. A duplex printing is thus performed.

The image inspection apparatus 3 inspects images formed on the sheet P printed by the image forming apparatus 2 while conveying the sheet P. Details of the image inspection apparatus 3 will be described later.

The post-processing apparatus 4 is an apparatus which performs variety of post-processing on and discharges the sheet P on which the images are printed by the image forming apparatus 2 and for which the images are inspected by the image inspection apparatus 3. Content of the post-processing may include at least one of a sorting task such as sorting and stacking of sheets P, stapling of sheets P, insertion of paper between sheets P, folding of sheets P in a variety of manners, or insertion of sheets P into an envelope. The image forming system 1 can be provided with the post-processing apparatus 4 which has functions necessary for purposes.

Next, details of the image inspection apparatus 3 are described.

As illustrated in FIGS. 1 to 4, the image inspection apparatus 3 includes: the conveyors 21A and 21B; hold rollers 22A and 22B; lifting/lowering motors 23A and 23B; the sheet receptor (conveyed object receptor) 24; inspection units 25A and 25B; an introduction guide 26; an intermediate guide 27; a discharge guide 28; a controller 29; and a chassis 30 which houses or holds the respective components. The conveying apparatus is formed of the components of the image inspection apparatus 3 other than the inspection units 25A, 25B.

The conveyor 21A conveys the sheet P conveyed from the image forming apparatus 2 while sucking and holding the sheet P by air suction. The conveyor 21A is arranged such that a conveyance surface 31*a* of the conveyor 21A described later is on an upward surface side (faces upward). The conveyor 21A includes a conveyance belt 31, a drive roller 32, a driven rollers 33 to 35, a belt motor 36, a platen 37, a chamber 38, and a fan 39.

The conveyance belt 31 conveys the sheet P while sucking and holding the sheet P. The conveyance belt 31 is an annular belt which is stretched over the drive roller 32 and the driven rollers 33 to 35. A large number of belt holes (not illustrated) are formed in the conveyance belt 31. The conveyance belt 31 sucks and holds the sheet P on the conveyance surface 31*a* by a suction force generated in the belt holes by driving the fan 39. The conveyance surface 31*a* is an upward surface of a horizontal portion of the conveyance belt 31 between the drive roller 32 and the driven roller 33. The conveyance belt 31 of the conveyor 21A rotates clockwise in FIG. 3 to convey the sheet P sucked and held on the conveyance surface 31*a* to the right.

The drive roller 32 rotates the conveyance belt 31.

The driven rollers 33 to 35 support the conveyance belt 31 together with the drive roller 32. The driven rollers 33 to 35 are rotated by following the rotating conveyance belt 31. The driven roller 33 is arranged on the left side of the drive roller 32 at the same height as the drive roller 32. The driven rollers 34 and 35 are arranged at the same height and spaced apart from each other in the right-left direction below the drive roller 32 and the driven roller 33.

The belt motor 36 drives the drive roller 32 to rotate.

The platen 37 is arranged below the conveyance belt 31 between the drive roller 32 and the driven roller 33 and slidably supports a downward surface of the conveyance belt 31. The platen 37 has a large number of suction holes (not illustrated) formed in portions through which the belt holes of the conveyance belt 31 pass.

The chamber 38 forms a negative pressure chamber for generating the suction force in the belt holes of the conveyance belt 31 through the suction holes of the platen 37. The chamber 38 is provided on a downward surface side of the platen 37 between the drive roller 32 and the driven roller 33.

The fan 39 exhausts air from the chamber 38. Thus, the fan 39 generates a negative pressure in the chamber 38 and sucks air through the suction holes of the platen 37 and the belt holes of the conveyance belt 31. As a result, the fan 39 generates a negative pressure in the belt holes to suck the sheet P onto the conveyance surface 31*a*.

The conveyor 21B conveys the sheet P conveyed from the conveyer 21A while sucking and holding the sheet P by air suction and discharges the sheet P to the post-processing apparatus 4. The conveyor 21B has the same components as those of the conveyor 21A and is arranged upside down with respect to the conveyor 21A. That is, the conveyor 21B is arraneged such that a conveyance surface 31*a* of the conveyor 21B is on a downward surface side (faces downward).

The conveyor 21B is arranged adjacent to the downstream side (right side) of the conveyor 21A with a height position of the conveyance surface 31*a* of the conveyor 21B being the same as a height position of the conveyance surface 31*a* of the conveyor 21A.

In the conveyor 21B, the conveyance belt 31 rotates counterclockwise in FIG. 3 to convey the sheet P sucked on the conveyance surface 31*a* to the right.

The hold rollers 22A and 22B are rollers for holding the sheet P onto the conveyance belts 31 of the conveyors 21A and 21B, respectively. The hold rollers 22A and 22B are rotated by following the rotating conveyance belts 31. The hold rollers 22A and 22B are arranged at the upstream ends of the conveyance surfaces 31*a* of the conveyors 21A and 21B, respectively.

The lifting/lowering motors 23A and 23B lift and lower the conveyors 21A and 21B between a conveyance position and a retreat position, respectively.

The conveyance positions of the conveyors 21A and 21B are positions at which the sheet P is conveyed and are positions of the conveyors 21A and 21B indicated by the solid lines in FIG. 3.

The retreat positions of the conveyors 21A and 21B are positions at a time of removing a jam of the sheet P.

The retreat position of the conveyor 21A is a position of the conveyor 21A indicated by the broken line in FIG. 3 and is lower than the conveyance position of the conveyor 21A.

The retreat position of the conveyor 21B is a position of the conveyor 21B indicated by the broken line in FIG. 3 and is higher than the conveyance position of the conveyor 21B. When the conveyor 21B is located at the retreat position, the conveyance surface 31*a* of the conveyor 21B is arranged at a position higher than a lower intermediate guide plate 27*b* and a lower discharge guide plate 28*b* described later.

The sheet receptor 24 is arranged below the conveyor 21B and receives the sheet P having fallen from the conveyor 21B. As illustrated in FIG. 4, the sheet receptor 24 is formed of a sheet metal arranged below the conveyor 21B. The sheet receptor 24 is not limited to the sheet metal and may be any member capable of receiving the sheet P having fallen from the conveyor 21B.

The inspection unit 25A reads an image formed on an upward surface (obverse surface) of the sheet P conveyed by the conveyor 21A for inspection. The inspection unit 25A is arranged above the conveyor 21A.

The inspection unit 25B reads an image formed on a downward surface (reverse surface) of the sheet P conveyed by the conveyor 21B for inspection. The inspection unit 25B is arranged below the conveyor 21B.

Each of the inspection units 25A and 25B includes a CIS (Contact Image Sensor). The inspection units 25A and 25B are not limited to the CIS and may be sensors of other principles or structures, or may be cameras.

The introduction guide 26 guides, to the conveyor 21A, the sheet P conveyed from the image forming apparatus 2 to the image inspection apparatus 3. The introduction guide 26 is arranged adjacent to the upstream side of the conveyor 21A. The introduction guide 26 includes an upper introduction guide plate 26*a* for guiding the upward surface side of the sheet P and a lower introduction guide plate 26*b* for guiding the downward surface side of the sheet P.

The intermediate guide 27 guides the sheet P between the conveyor 21A and the conveyor 21B. The intermediate guide 27 is arranged adjacent to the downstream side of the conveyor 21A and adjacent to the upstream side of the conveyor 21B. The intermediate guide 27 includes an upper intermediate guide plate 27*a* for guiding the upward surface side of the sheet P and the lower intermediate guide plate 27*b* for guiding the downward surface side of the sheet P. The lower intermediate guide plate 27*b* functions as a supporter for supporting the sheet P.

The discharge guide 28 guides the sheet P discharged from the conveyor 21B to the post-processing apparatus 4. The discharge guide 28 is arranged adjacent to the downstream side of the conveyor 21B. The discharge guide 28 includes an upper discharge guide plate 28*a* for guiding the upward surface side of the sheet P and the lower discharge guide plate 28*b* for guiding the downward surface side of the sheet P. The lower discharge guide plate 28*b* functions as a supporter for supporting the sheet P.

The controller 29 controls operations of the respective components of the image inspection apparatus 3. The controller 29 includes a CPU, a RAM, a ROM, a hard disk drive, and the like.

Next, operations of the image forming system 1 are described.

In the embodiment, a duplex printing is performed by the image forming apparatus 2. The image forming apparatus 2 performs printing on one surface of the sheet P by the inkjet heads 11 while conveying the sheet P by the conveyor 13, reverses the sheet P with the one surface printed in the conveyance path 12, and then refeeds the reversed sheet P to the conveyor 13. Then, the image forming apparatus 2 performs printing on the other surface of the sheet P with the one surface printed by the inkjet heads 11 while conveying the sheet P by the conveyor 13. Thus, images are printed on both sides of the sheet P. The sheet P on which the duplex printing has been performed is conveyed from the image forming apparatus 2 to the image inspection apparatus 3.

The sheet P conveyed from the image forming apparatus 2 to the image inspection apparatus 3 is guided to the conveyor 21A by the introduction guide 26. The sheet P guided to the conveyor 21A is pressed against the conveyance surface 31*a* by the hold roller 22A. The conveyor 21A conveys the sheet P while sucking and holding the sheet P on the conveyance surface 31*a* by air suction. The inspection unit 25A reads the image formed on the upward surface of the sheet P conveyed by the conveyor 21A for inspection.

The sheet P conveyed by the conveyor 21A is guided to the conveyor 21B by the intermediate guide 27. The sheet P guided to the conveyor 21B is pressed against the conveyance surface 31*a* by the hold roller 22B. The conveyor 21B conveys the sheet P while sucking and holding the sheet P on the conveyance surface 31*a* by air suction. The inspection unit 25B reads the image formed on the downward surface of the sheet P conveyed by the conveyor 21B for inspection.

The sheet P conveyed by the conveyor 21B is guided to the post-processing apparatus 4 by the discharge guide 28. The post-processing apparatus 4 performs the post-processing on the sheet P conveyed from the image inspection apparatus 3.

Next, operations of the image inspection apparatus 3 when a jam of the sheet P occurs during the operation of printing and image inspection in the image forming system 1 described above are described.

When the jam of the sheet P occurs in the image forming system 1, the image forming apparatus 2, the image inspection apparatus 3, and the post-processing apparatus 4 stop conveying the sheet(s) P.

In the image inspection apparatus 3, the controller 29 stops the belt motors 36 and the fans 39 of the conveyors 21A and 21B. As a result, the suction force (holding force) sucking the sheet P onto the conveyance surfaces 31*a* is released and the conveyance of the sheet P by the conveyance belts 31 is stopped in the conveyors 21A and 21B.

Next, the controller 29 drives the lifting/lowering motor 23A to lower the conveyor 21A from the conveyance position to the retreat position. The controller 29 drives the lifting/lowering motor 23B to lift the conveyor 21B from the conveyance position to the retreat position. Thus, the image inspection apparatus 3 enters into a state of a jam removal in which a user performs a jam removal operation of removing the sheet P remaining in the apparatus.

Figure 5:
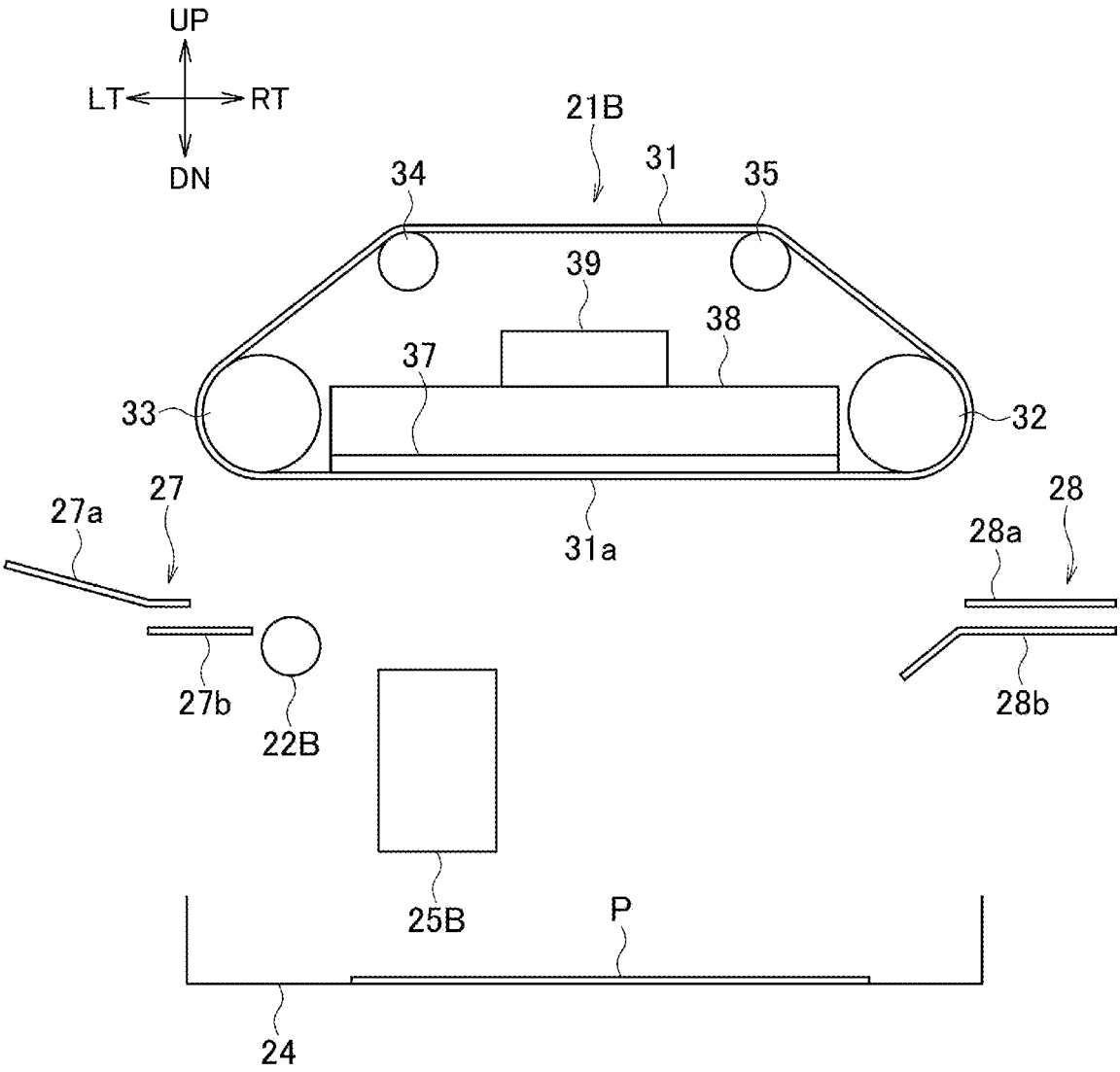
FIG. 5 illustrates the image inspection apparatus with a sheet having fallen on the sheet receptor in a state of a jam removal.

Here, if the sheet P remains in the conveyor 21B when the conveyance is stopped due to the occurrence of the jam, the sheet P falls from the conveyor 21B due to stop of the fan 39 of the conveyor 21B and release of the suction force of the conveyance surface 31*a* as described above. As illustrated in FIG. 5, the sheet P having fallen from the conveyor 21B is received by the sheet receptor 24. The sheet P is removed by the user who performs the jam removal operation.

Figure 6:
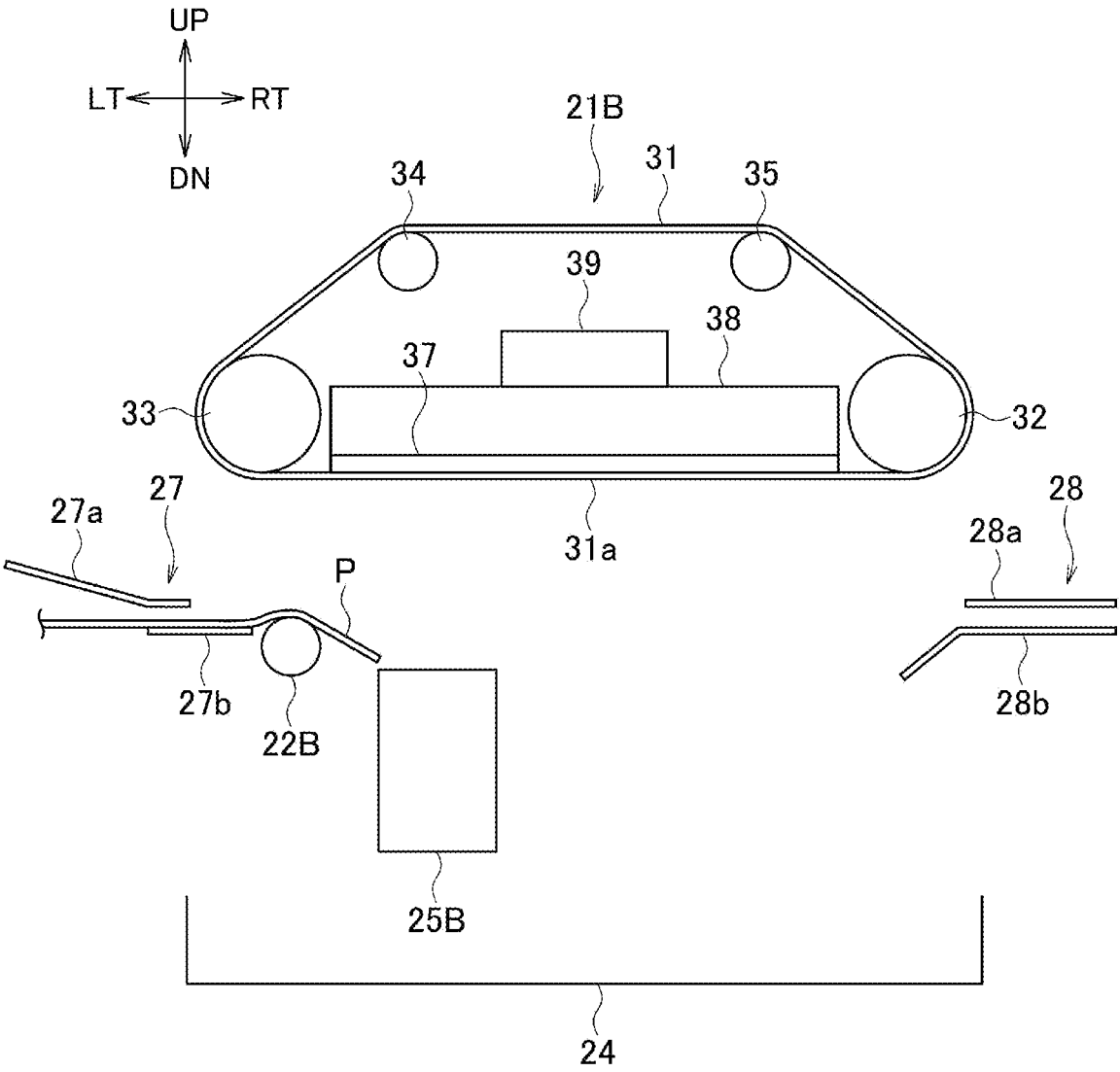
FIG. 6 illustrates the image inspection apparatus with a sheet supported by a lower intermediate guide plate in a state of a jam removal.

If the sheet P remains at a position bridging the conveyance surface 31*a* of the conveyor 21B and the intermediate guide 27 (lower intermediate guide plate 27*b*) when the conveyance is stopped due to the occurrence of the jam, the sheet P is supported by the lower intermediate guide plate 27*b* as illustrated in FIG. 6 in response to entrance of the image inspection apparatus 3 into the state of the jam removal. That is, the suction force of the conveyance surface 31*a* is released and then the sheet P is supported by the lower intermediate guide plate 27*b* with the downstream end of the sheet P separated from the conveyance surface 31*a* and hanging down toward the downstream side of the lower intermediate guide plate 27*b*. The sheet P is removed by the user who performs the jam removal operation.

If the sheet P remains at a position bridging the conveyance surface 31*a* of the conveyor 21B and the lower discharge guide plate 28*b* when the conveyance is stopped due to the occurrence of the jam, the sheet P is supported by the lower discharge guide plate 28*b* in response to entrance of the image inspection apparatus 3 into the state of the jam removal. That is, the suction force of the conveyance surface 31*a* is released and then the sheet P is supported by the lower discharge guide plate 28*b* with the upstream end of the sheet P separated from the conveyance surface 31*a* and hanging down toward the upstream side of the lower discharge guide plate 28*b*. The sheet P is removed by the user who performs the jam removal operation.

As described above, the image inspection apparatus 3 includes the sheet receptor 24 which receives the sheet P having fallen from the conveyor 21B.

If there is no sheet receptor 24 unlike the embodiment above, it is difficult for the user to identify where the sheet P has fallen from the conveyor 21B in the apparatus (inside the chassis 30). Further, if the fan 39 is not stopped to prevent the sheet P from falling unlike the embodiment above, the user may not notice the sheet P being sucked and held by the conveyor 21B.

In contrast to the above, in the image inspection apparatus 3, the sheet receptor 24 receives the sheet P having fallen from the conveyor 21B at the time of removing the jam. Thus, the user who performs the jam removal operation can easily identify the location of the sheet P having fallen inside the apparatus by looking at the sheet receptor 24. Then, the user can easily remove the sheet P.

In the image inspection apparatus 3, the conveyor 21B releases the suction force of the conveyance surface 31*a* and lifts (moves upward) from the conveyance position to the retreat position at the time of removing the jam. Thus, if there is the sheet P remaining at the position bridging the conveyance surface 31*a* of the conveyor 21B and the lower intermediate guide plate 27*b*, the lower intermediate guide plate 27*b* supports the sheet P whereby the downstream end of the sheet P hangs down toward the downstream side of the lower intermediate guide plate 27*b*. If there is the sheet P remaining at the position bridging the conveyance surface 31*a* of the conveyor 21B and the lower discharge guide plate 28*b*, the lower discharge guide plate 28*b* supports the sheet P whereby the upstream end of the sheet P hangs down toward the upstream side of the lower discharge guide plate 28*b*. Thus, the user who performs the jam removal operation can easily find the sheet P supported by the lower intermediate guide plate 27*b* and the sheet P supported by the lower discharge guide plate 28*b*. Then, the user can easily remove the sheet P.

Although the lower intermediate guide plate 27*b* and the lower discharge guide plate 28*b* function as supporters for supporting the sheet P at the time of removing the jam in the embodiment above, the supporters may be formed of members different from the guide plates. Further, at least one of the supporters arranged at the upstream side of the conveyor 21B or the supporter arranged at the downstream side of the conveyor 21B may be omitted.

Although the conveyors 21A and 21B convey the sheet P while sucking and holding the sheet P by air suction in the embodiment above, the method of holding and conveying the sheet P is not limited to this. For example, a method of conveying the sheet P while sucking and holding the sheet P on the conveyance belts 31 by electrostatic force or a method of conveying the sheet P while holding the sheet P by bonding the sheet P to rollers or the conveyance belts 31 with an adhesive may be employed.

Although the conveyors 21A and 21B are arranged such that the conveyance surfaces 31*a* are horizontal in the embodiment above, the conveyors 21A and 21B may be arranged such that the conveyance surfaces 31*a* are inclined in the conveyance direction of the sheet P. In this case, the size of the image inspection apparatus 3 can be reduced while having the effect that the location of the sheet P can be easily identified by receiving the sheet P on the sheet receptor 24 at the time of removing the jam and the effect that the sheet P supported by the lower intermediate guide plate 27*b* and the sheet P supported by the lower discharge guide plate 28*b* can be easily found at the time of removing the jam as described above.

Embodiments of the disclosure have, for example, the following configuration.

A conveying apparatus includes: a conveyor including a conveyance surface facing downward and configured to convey a conveyed object having a sheet-like shape; and a conveyed object receptor arranged below the conveyor and configured to receive the conveyed object having fallen from the conveyor.

The conveying apparatus above may further include a supporter arranged at at least one of an upstream side or a downstream side of the conveyor in a conveyance direction of the conveyed object and configured to support the conveyed object. Upon removal of a jam of the conveyed object, the conveyor may release a holding force for holding the conveyed object on the conveyance surface and moves upward to a position where the conveyance surface is arranged at a position higher than the supporter.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A conveying apparatus comprising:

a conveyor including a conveyance surface facing downward and configured to convey a conveyed object having a sheet-like shape;

a conveyed object receptor arranged below the conveyor and configured to receive the conveyed object having fallen from the conveyor;

a first guide plate at least partially spaced from and upstream of the conveyor in a conveyance direction of the conveyed object and configured to support the conveyed object; and a second guide plate spaced from and downstream of the conveyor in the conveyance direction of the conveyed object and configured to support the conveyed object, wherein the first guide plate supports and guides the conveyed object to the conveyor and is at least partially spaced from the conveyor in the conveyance direction of the conveyed object so as to support an upstream portion of the conveyed object and to not support a downstream portion of the conveyed object when the conveyed object remains at a first position bridging the conveyance surface and the first guide plate during a first time when conveyance of the conveyed object is stopped due to an occurrence of a jam, whereby the downstream portion of the conveyed object hangs toward the conveyed object receptor thereby permitting removal of the conveyed object supported by the first guide plate during the first time, and the second guide plate is spaced from the conveyor in the conveyance direction of the conveyed object so as to support a downstream portion of the conveyed object and to not support an upstream portion of the conveyed object when the conveyed object remains at a second position bridging the conveyance surface and the second guide plate during a second time when conveyance of the conveyed object is stopped due to the occurrence of the jam, whereby the upstream portion of the conveyed object hangs toward the conveyed object receptor thereby permitting removal of the conveyed object supported by the second guide plate during the second time.

2. The conveying apparatus according to claim 1, wherein, upon removal of the jam of the conveyed object, the conveyor releases a holding force for holding the conveyed object on the conveyance surface and lifts to a position where the conveyance surface is arranged at a position higher than the first guide plate and the second guide plate.

3. The conveying apparatus according to claim 1, wherein, upon performing removal of the jam of the conveyed object, the conveyor releases a holding force for holding the conveyed object on the conveyance surface and rises linearly upward to a position where the entirety of the conveyance surface is arranged at a position higher than the first guide plate and the second guide plate.

4. The conveying apparatus according to claim 1, wherein the apparatus conveys the conveyed object from a printer for printing an image on the conveyed object, and to a post-processing apparatus further processing of the conveyed object, the conveyor is located downstream of the printer and upstream of the post-processing apparatus to receive the conveyed object from the printer and to convey the conveyed object to the post-processing apparatus, the first guide plate is configured to guide the conveyed object from the printer to the conveyor, and the second guide plate is configured to guide the conveyed object discharged from the conveyor to the post processing apparatus.

* * * * *